US006273050B1

(12) United States Patent
Ko

(10) Patent No.: US 6,273,050 B1
(45) Date of Patent: Aug. 14, 2001

(54) TWO-STROKE CYLINDER

(76) Inventor: Wen-Chang Ko, No. 6, Lane 450, Chung-Hua Rd., Tou-Lu City, Yun-Lin Hsien (TW)

( * ) Notice: Subject to any disclaimer, the term of this patent is extended or adjusted under 35 U.S.C. 154(b) by 0 days.

(21) Appl. No.: 09/425,134

(22) Filed: Oct. 21, 1999

(51) Int. Cl.[7] ..... F01B 3/10; F01M 1/08
(52) U.S. Cl. ..... 123/196 R
(58) Field of Search ..... 123/196 R, 73 CB, 123/74 A, 73 C, 74 R, 73 PP, 193.2, 193.4, 193.3

(56) References Cited

U.S. PATENT DOCUMENTS 3,695,240 * 10/1972 Cookson ..... 123/193.2
4,993,380 * 2/1991 Hsu ..... 123/193.2
5,065,708 * 11/1991 Wehle et al. ..... 123/73 C

* cited by examiner

*Primary Examiner*—Willis R. Wolfe
*Assistant Examiner*—Hyder Ali
(74) *Attorney, Agent, or Firm*—Pro-Techtor International Services

(57) ABSTRACT

An improved two-stroke cylinder that includes a compression chamber formed by the cylinder wall and an exhaust channel on the cylinder wall, an exhaust means, and a plurality of surrounding blades. A lubricant supply channel is provided that lies outside the plane of the interior of the cylinder. A set of lubricant inlets are formed in the lubricant supply channel to allow lubricant to flow into the cylinder. When the cylinder is in operation, the fuel and lubricant are separately injected, and the lubricant is directly injected into the lower portion of the cylinder. Thus the piston and the piston ring are well lubricated, which extends the life of the engine.

1 Claim, 6 Drawing Sheets

TWO-STROKE CYLINDER

BACKGROUND OF THE INVENTION

1. Field of Invention

The invention relates to an improved two-stroke cylinder and, in particular, to a highly efficient cylinder in which lubricant and fuel are separately functioning to lower the emission of carbon monoxide and carbohydrogenic compounds.

2. Related Art

A conventional two-stroke cylinder is shown in FIG. 1. The cylinder comprises a compression chamber 3 formed by a cylinder wall 2, an exhaust channel 6 on the cylinder wall 2, an exhauster 5 and surrounding blades 4. Since the conventional cylinder 1 does not have the structure to separate lubricant and fuel, therefore the oil injected into the compression chamber is a mixture of the fuel and lubricant. The fuel therefore can not have full combustion and a large amount of carbon monoxide and carbohydrogenic compounds are emitted to the environment. Additionally, conventional cylinders are easily failed under long time operation. On the other hand, if the engine is at rest for a long time without operation or a new vehicle is not sold for a long time, the crankcase of the cylinder can be flooded with lubricant so that the engine can not be or is not easy to be started.

SUMMARY OF THE INVENTION

In view of the foregoing, a main object of the present invention is to provide an independent lubricant guiding structure for the cylinder so that the fuel and lubricant can be separately functioning. The defect of releasing a large amount of carbon monoxide and carbohydrogenic compounds due to incomplete combustion of the combination of fuel and lubricant will not happen. The cylinder can be directly lubricated without the occurrence of the engine failure. The piston is designed to cover the fuel outlet so that a vehicle at rest for a long time will not be hard to start due to the lubricant filling the crankcase.

Furthermore, the invention provides a smooth motion for the piston, lowers the abrasion and noise of the cylinder wall to the least and thus greatly raises the operation efficiency.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
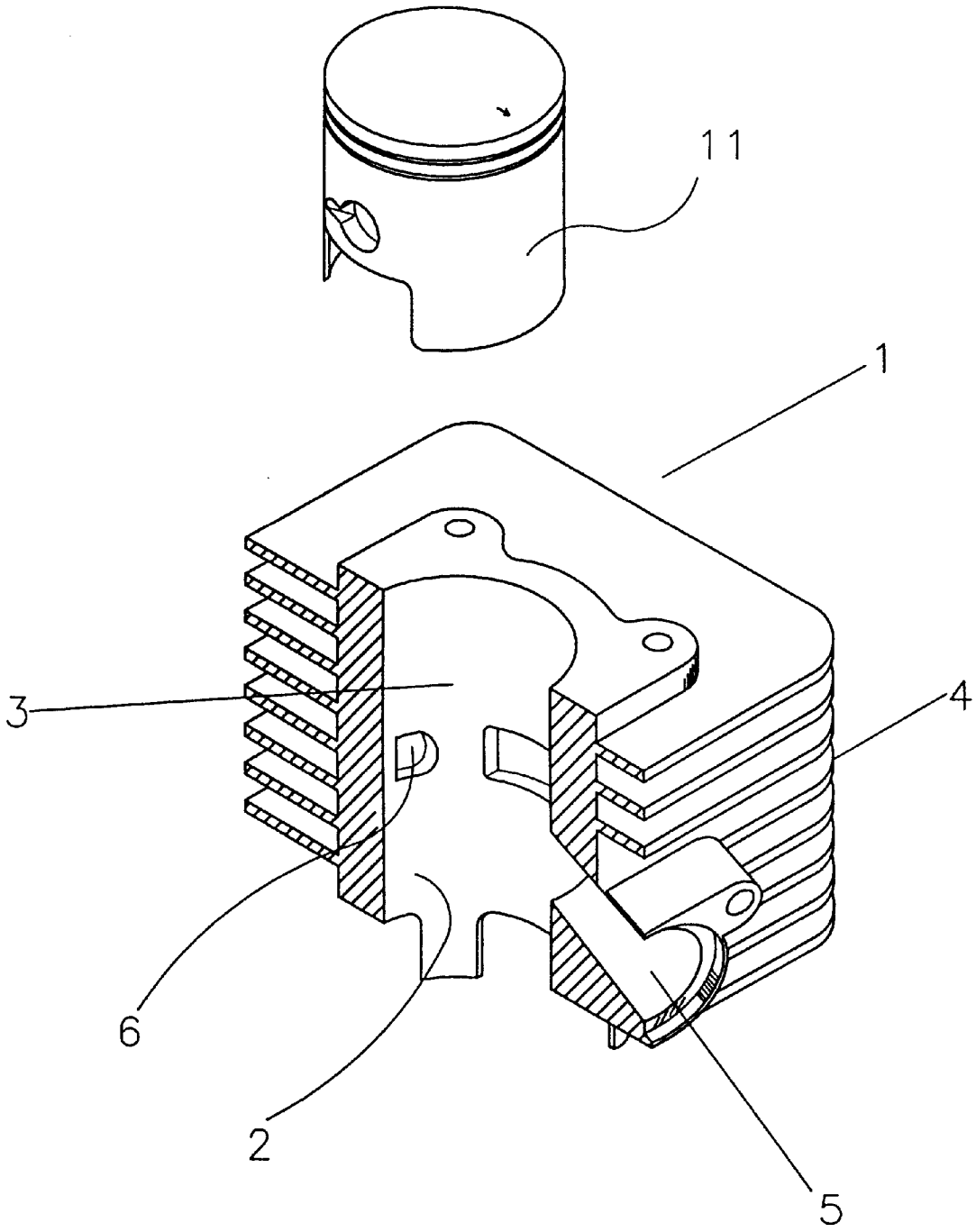
(PRIOR ART) Fig.1
FIG. 1 is a schematic structure of a conventional two-stroke cylinder.
Figure 2:
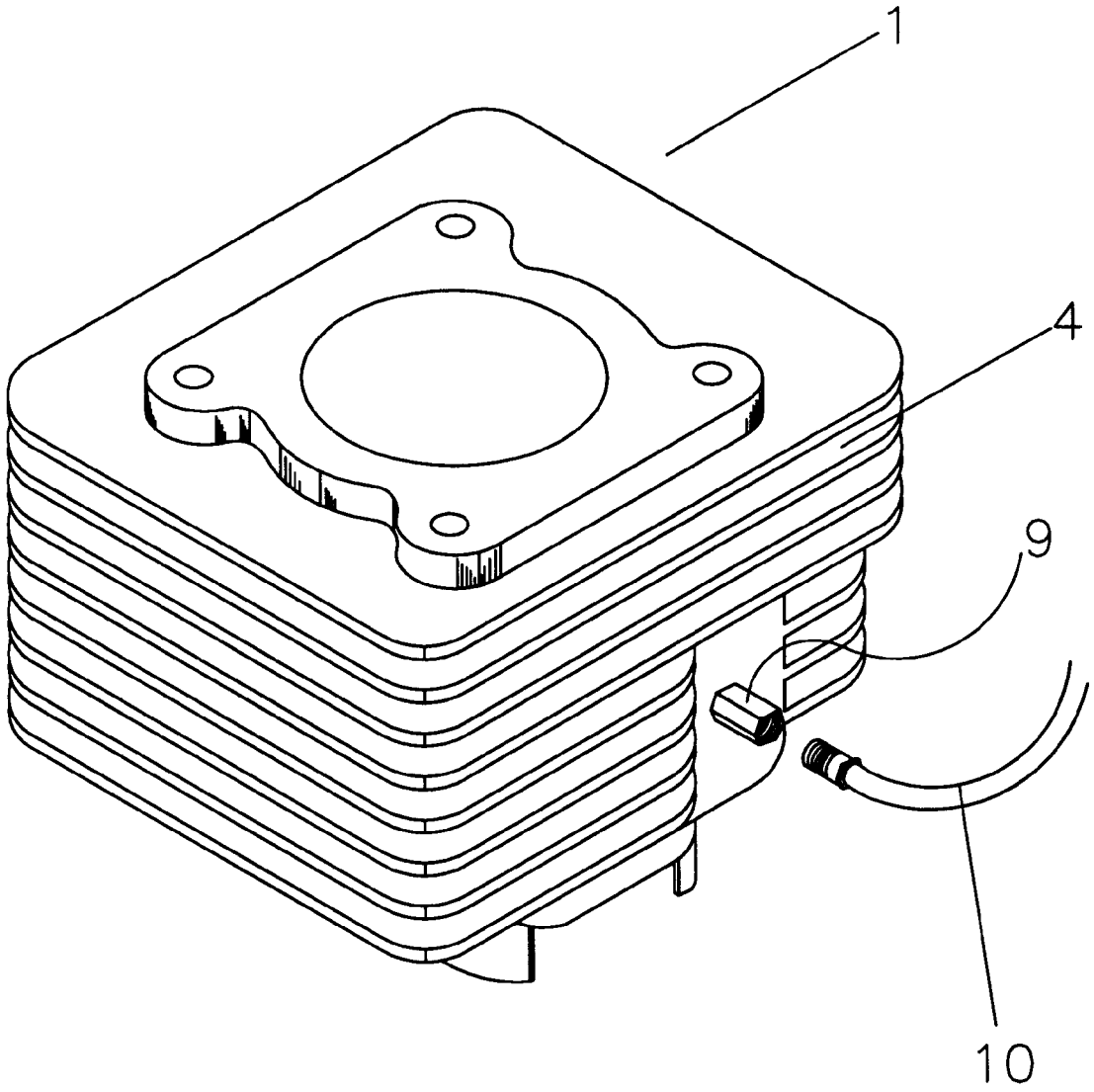
FIG. 2 is a schematic appearance of the present invention.
Figure 3:
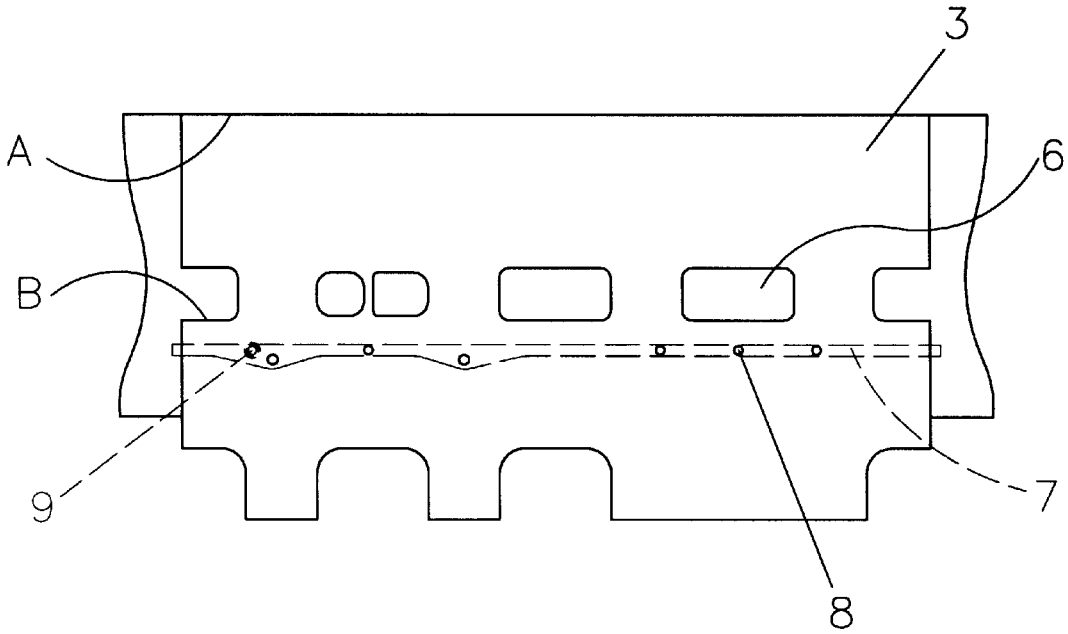
FIG. 3 shows a structure and a schematic planar explosion view of the first embodiment of the invention.
Figure 3:
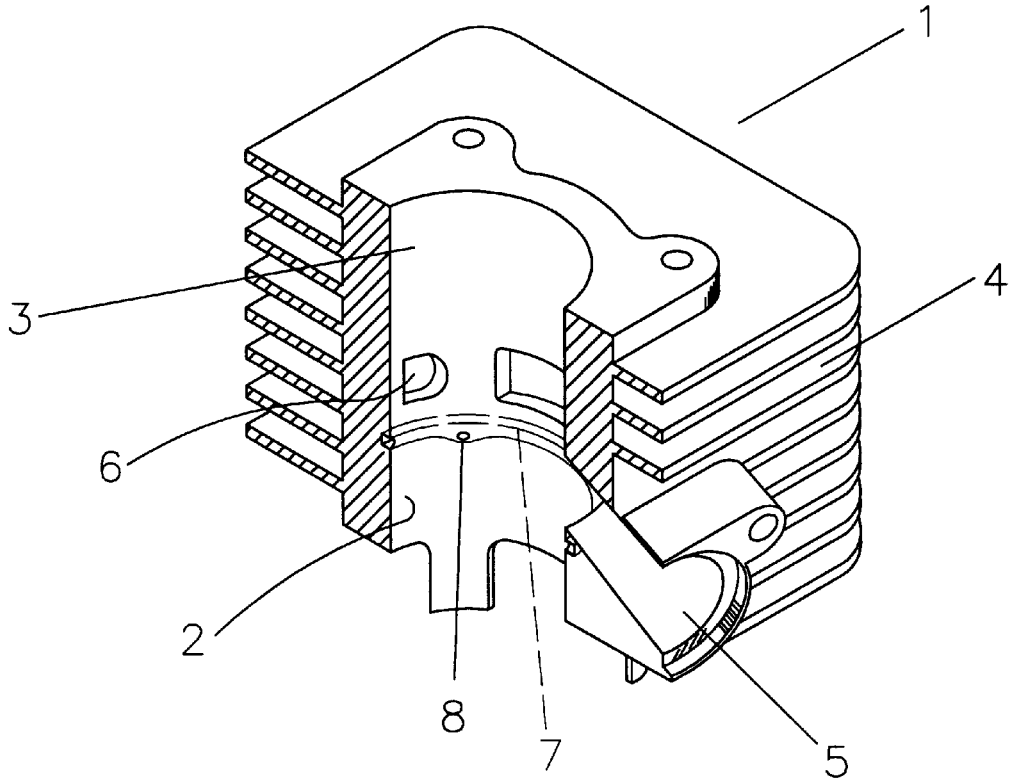

Please refer to FIGS. 2 and 3, which are an appearance, a structure and a schematic planar explosion view of the first embodiment of the invention, respectively. As shown in the graph, the cylinder 1 comprises a compression chamber 3 formed by the conventional cylinder wall 2, an exhaust channel 6 on the cylinder wall 2, an exhauster 5 and surrounding blades 4. The characteristics of the invention are described in the following. The lower portion of the exhaust channel 6 of the cylinder wall 2 is hidden in an inner channel 7 with a surrounding wall in the cylinder wall 2, and a plurality of holes 8 are provided at where the inner channel 7 is positioned on the cylinder wall 2. A set of fuel injection openings 9 is formed on proper positions corresponding to the inner channel 7 outside the cylinder 1 to provide the connection of guiding pipes 10 for guiding lubricant.

A piston 11 is provided within the above mentioned cylinder 1 and has its motion within the compression chamber 3 formed by the upper and lower stop points A, B. The lubricant for two-stroke engines is guided to flow within the inner channel 7 under the compression chamber 3. In each stroke of fuel injection, combustion and exhaust emission, the fuel and lubricant are separately functioning. That is, the upward-and-downward motion of the piston 11 is driven by the fuel injection, ignition, combustion and exhaust emission. The piston motion can bring the lubricant flowing therebelow up to the compression chamber 3 to perform the lubrication, wherein the oil outlet of the lubricant is positioned at the second piston ring. Therefore, under the circumstance that the fuel and lubricant are not mixed and thus are more effectively adhered to the cylinder wall 2, we obtain the following test results:

| | |
|---|---|
| Carbon monoxide | 0.37 |
| Carbohydrogenic compounds | 2010 |
| Carbon dioxide | 11.6 |
| A/F | 16.3 |

The previous results are not only lower than the emission standard, the piston motion is also very smooth and fast. The abrasion and noise are greatly reduced, and the power is raised by at least 10%. The instant invention has samples for the examiners to test.

Figure 4:
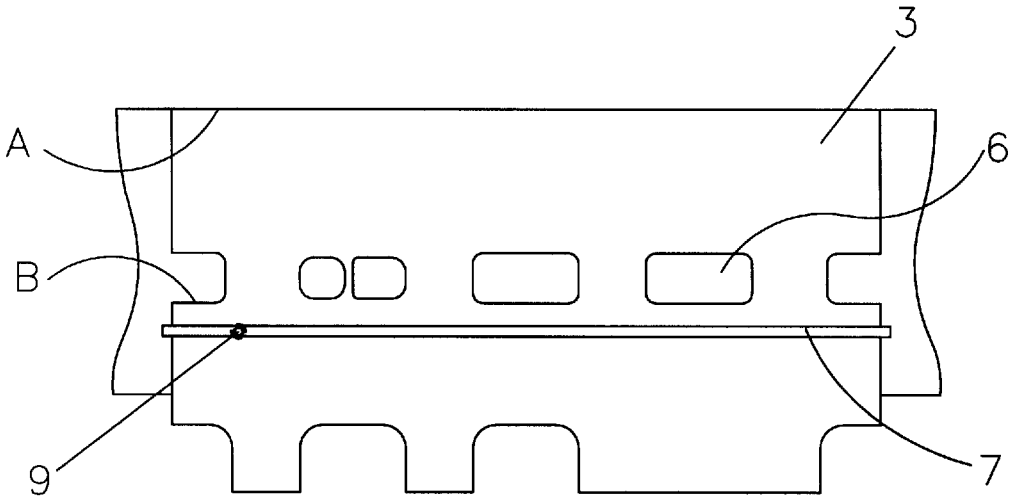
FIG. 4 shows a structure and a schematic planar explosion view of the second embodiment of the invention.
Figure 4:
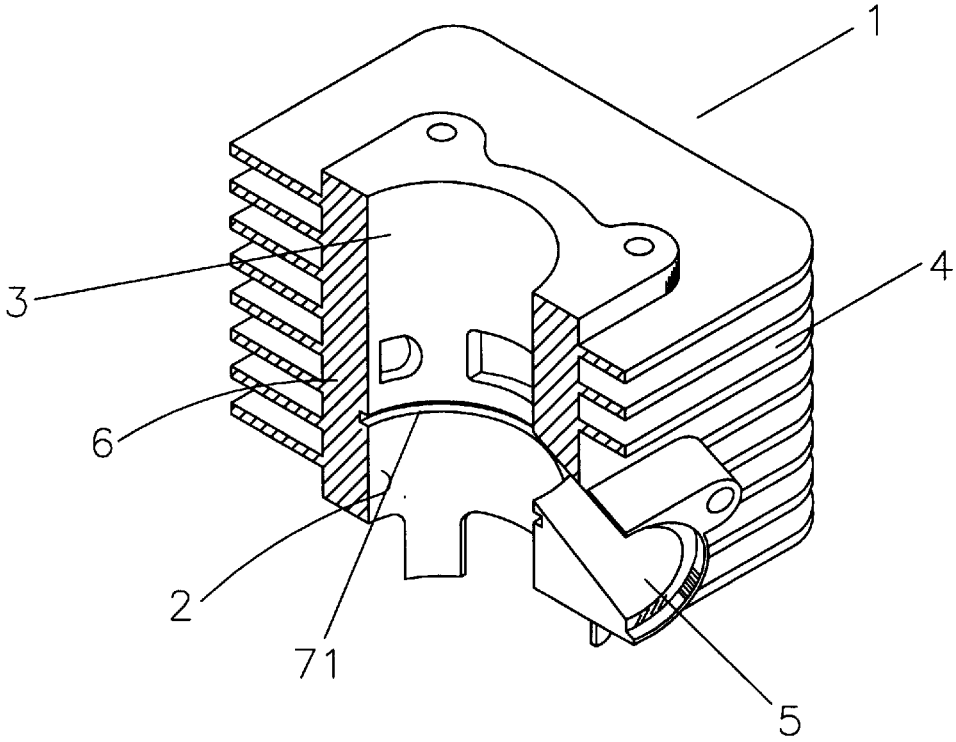
Figure 5:
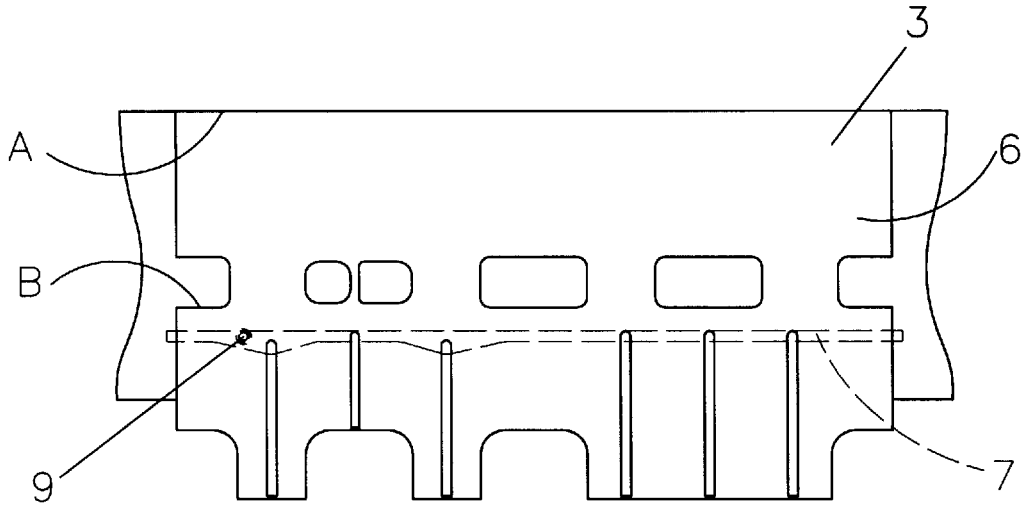
FIG. 5 shows a structure and a schematic planar explosion view of the third embodiment of the invention.
Figure 5:
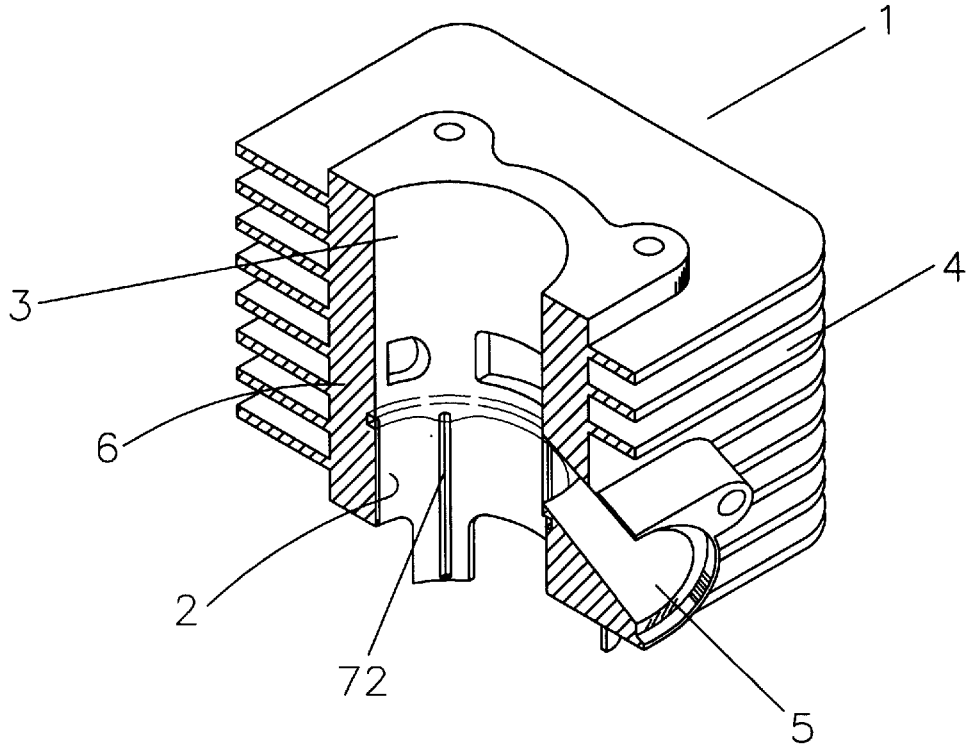
Figure 6:
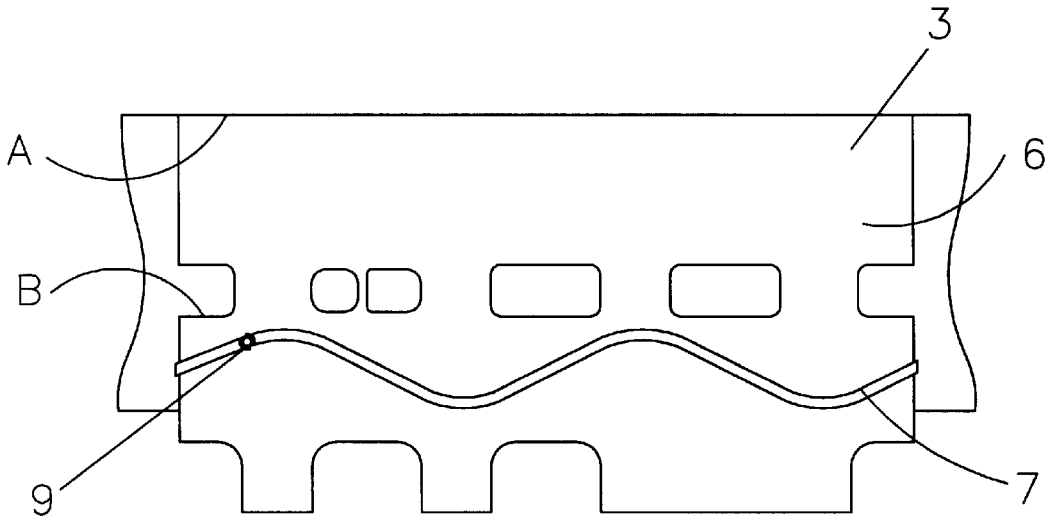
FIG. 6 shows a structure and a schematic planar explosion view of the fourth embodiment of the invention.
Figure 6:
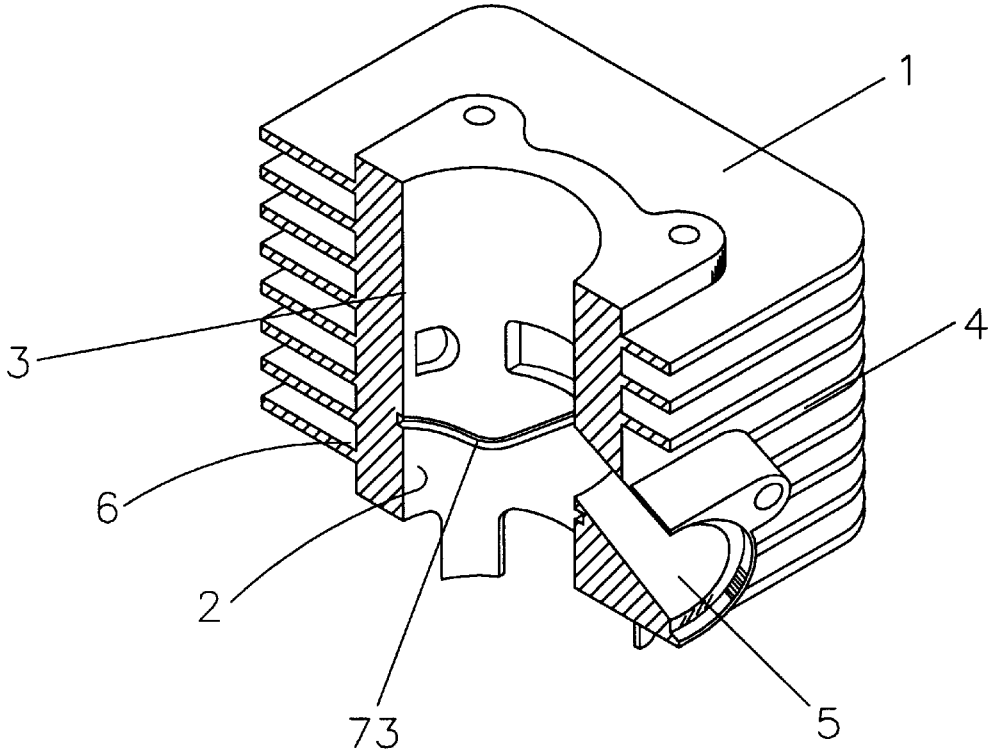

Please refer to FIGS. 4 and 5, which show a structure and a schematic planar explosion view of the first and second embodiments of the invention, respectively. According to the graphs, the previous structure further comprises an annular fuel groove 71 or a wavy fuel groove 73 in the inner channel 7 on the Surface of the cylinder wall 2. (As shown in FIG. 6, the fuel injection opening 9, annular fuel groove 71 and the highest point of the wavy fuel groove 73 are best set to be at the lower stop point of the piston, 5 mm under the second piston ring.) Or, alternatively, a plurality of longitudinal downward fuel guiding (grooves 72 are provided on the surface of the cylinder wall 2 so that the lubricant on the cylinder can more effectively lubricate the engine. Furthermore, the fuel and lubricant can be separately so as to promote the efficiency of the cylindrical operation.

The structure of the instant invention prevents lubricant from entering the crankcase by the blocking of the piston under the exhaust channel. This design can effectively prevent the accumulation of lubricant within the crankcase even when the engine is not running for a long time. Also, the compression chamber can provide a thorough combustion for the fuel to effectively lower the production of carbon monoxide and carbohydrogenic compounds.

As disclosed in the foregoing, the present invention provides a two-stroke cylinder which complies with the emission standard and promotes the efficiency and power of the engine operation. Therefore, it indeed has practical and utility values.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cylinder for a two-stroke engine comprising:

a compression chamber formed by a cylinder wall;

an exhaust channel;

an exhaust means;

a plurality of surrounding heat dissipation blades; and a lubricant supply means; wherein said lubricant supply means comprises a lubricant supply channel that lies outside a plane of an interior of said cylinder, and a plurality of through holes are provided in said cylinder wall, said plurality of through holes being in communication with said lubricant supply channel, such that lubricant supplied to said lubricant supply channel is introduced to an interior surface of said cylinder wall through said through holes, the supplied lubricant being introduced to said cylinder separately from injected fuel, and said through holes are the only discontinuities created in said cylinder wall by said lubricant supply means.

* * * * *